United States Patent [19]

Hebert et al.

[11] 4,084,112

[45] Apr. 11, 1978

[54] INCANDESCENT LAMP HAVING TWO-PART INSULATIVE BASE

[75] Inventors: Roger T. Hebert, Peabody; Bernard T. Pike, Ipswich; Charles E. McCarthy, Gloucester; Richard J. Shea, Danvers, all of Mass.

[73] Assignee: GTE Sylvania Incorporated, Stamford, Conn.

[21] Appl. No.: 799,069

[22] Filed: May 20, 1977

[51] Int. Cl.[2] ..... H01J 5/48

[52] U.S. Cl. ..... 313/222; 313/318; 339/144 R; 339/145 R

[58] Field of Search ..... 313/222, 315, 316, 318; 339/144 R, 145 R

[56] References Cited

U.S. PATENT DOCUMENTS 3,852,631 12/1974 Evans ..... 313/318

*Primary Examiner*—Rudolph V. Rolinec
*Assistant Examiner*—Darwin R. Hostetter
*Attorney, Agent, or Firm*—Lawrence R. Fraley

[57] ABSTRACT

A high wattage incandescent lamp which includes a two-part ceramic base. Within the base is a barrier section which separates the base's cavity from the respective pin recesses. The structure permits utilization of hollow pins which include a flattened end portion for being retained within the base. The lamp is especially suited for studio, theatre, and television applications.

11 Claims, 3 Drawing Figures

INCANDESCENT LAMP HAVING TWO-PART INSULATIVE BASE

BACKGROUND OF THE INVENTION

The invention relates to incandescent lamps and particularly to high wattage incandescent lamps of the tungsten halogen variety. Even more particularly, the invention relates to lamps as described which are adapted for use in studio, theatre, and television applications.

Understandably, lamps employed in studios, theatres, television, and similar areas must provide high wattage outputs to satisfy the demanding lighting requirements of these environments. Heretofore, high wattage lamps (e.g. 2000 watts) were often of bulky, heavy construction with most of the bulk and weight concentrated in the areas of the lamp's base and pin structures. Many bases of the prior art were of porcelin or similar material and consisted of a solid, relatively large structure with solid metal pins extending therefrom. Another form of high wattage lamp base incorporated a metal "can" about the solid, insulative base to strengthen the base and enhance heat dissipation therefrom. This member also added appreciably to the size and weight of the lamp.

The incandescent lamp of the present invention overcomes the aforementioned undesirable requirements by utilizing a lightweight, two-part base which defines therein spaced openings for the lamp's press-sealed end portion and connector pins. The base structure further includes a barrier portion to separate the above openings. This feature substantially prohibits the lamp's sealing material, e.g. potting cement, from entering the connector pin openings. Leakage of sealing material from these openings can result in improper seating and contact of the base and pins, respectively, within a corresponding socket, said problem inherent in many prior art designs.

It is believed therefore that a high wattage incandescent lamp which is capable of overcoming the above described undesirable features of prior art lamp structures would constitute an advancement in the art.

OBJECTS AND SUMMARY OF THE INVENTION

It is a primary object of the present invention to enhance the incandescent lamp art by providing a lamp which obviates the aforementioned undesirable aspects of the prior art.

It is a more specific object of the present invention to improve the high wattage incandescent lamp art by providing a lamp of this type which utilizes a lightweight, two-part base.

These and other objects are achieved by the present invention wherein a high wattage incandescent lamp is provided which includes a light-transmitting envelope having a press-sealed end, a halogen atmosphere within the envelope, a pair of lead-in wires electrically connected to a filament structure also within the envelope, and a pair of spaced connector pins. The ends of the pins and the press-sealed end of the envelope are securedly retained within a two-part base of insulative material, said base including a barrier portion to substantially separate the press-sealed end and pin openings.

DETAILED DESCRIPTION OF THE PREFERRED EMBODIMENTS

Figure 2:
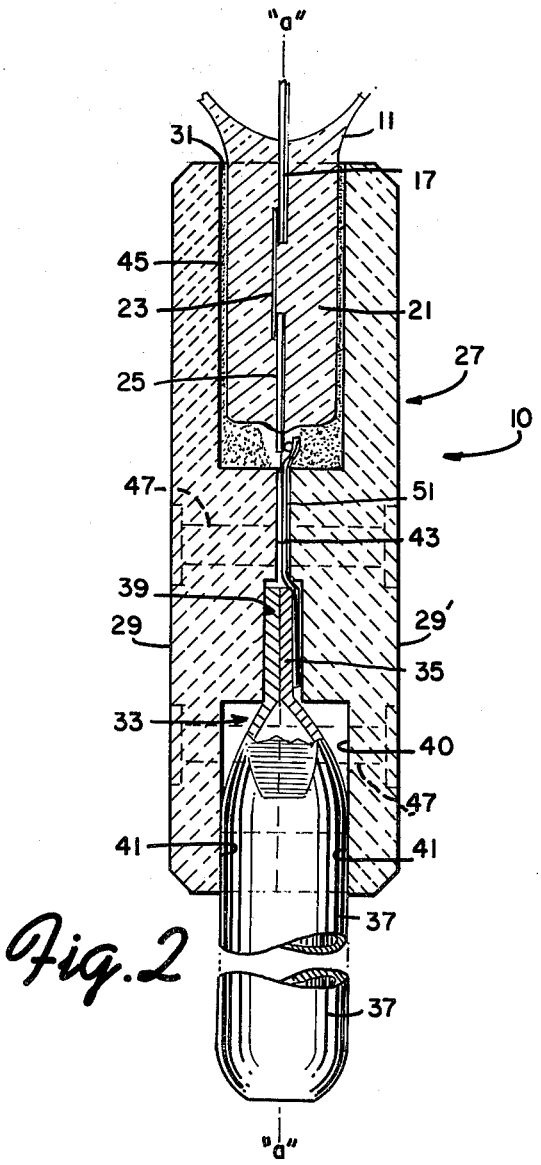
FIG. 2 is a partial side elevational view, in section, of the lamp of FIG. 1 as assembled.

For a better understanding of the present invention together with other and further objects, advantages and capabilities thereof, reference is made to the following disclosure and appended claims in connection with the above described drawings.

With particular reference to the drawings, there is shown a high wattage incandescent lamp 10 in accordance with a preferred embodiment of the invention. By high wattage is meant wattage output required in most studio, theatre, and television environments. Typically, these wattages range from about 1000 to about 10,000 watts. It is further understood that the lamp of the invention is adapted for being positioned within a socket which in turn may be connected to normal line current.

Lamp 10 comprises an elongated light-transmitting envelope 11 of vitreous material (e.g. quartz or high silica glass) which includes therein a halogen-containing atmosphere. Lamp 10 further includes a filament structure 13 fixedly mounted within envelope 11. As an example, structure 13 is preferably of tungsten and the corresponding halogen is preferably iodine or bromine. During lamp operation, the iodine or bromine vapor functions as a getter to combine with the tungsten that vaporizes from filament 13 onto an inner wall of envelope 11. The result is the formation of a tungsten iodide or bromide which migrates back to filament 13 where it is redeposited. This redeposit releases the iodine for further continuation of the cycle. Lamps of this variety are well known in the art and are referred to as tungsten halogen lamps.

Filament 13 is preferably of planar or bi-planar configuration and is mounted on horizontal quartz or high silica glass insulators 15. A pair of lead-in wires 17 and 19 are electrically connected to filament 13 and each have an end portion (17' and 19', respectively) sealed within the press-sealed end portion 21 of envelope 11. A first lead 17 is connected at end 17' to a thin metallic strip 23 while a second lead 19 is connected electrically at end 19' to another metallic strip 23'. A pair of secondary leads 20 are used to reinforce the position of lead-in wires 17 and 19 and the upper insulator 15. As shown, leads 20 are attached (e.g. by welding) to wires 17 and 19 at the illustrated points of juncture 24 adjacent the lower insulator 15. Strips 23 are preferably molybdenum and are thin to assure a positive hermetic seal in end portion 21. Attached to one end of strip 23 is a pair of extending leads 25 which project from end portion 21. Leads 25' are similarly arranged with regard to second strip 23'.

Figure 3:
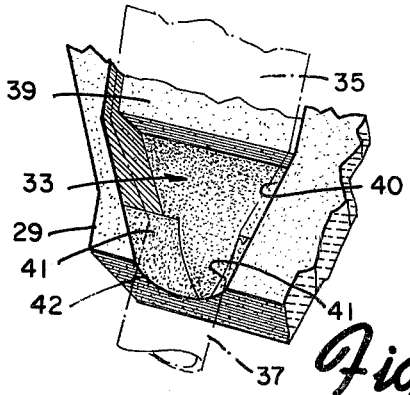
FIG. 3 is an enlarged partial view of the connector pin retention portion of the insulative base of the invention.
Figure 1:
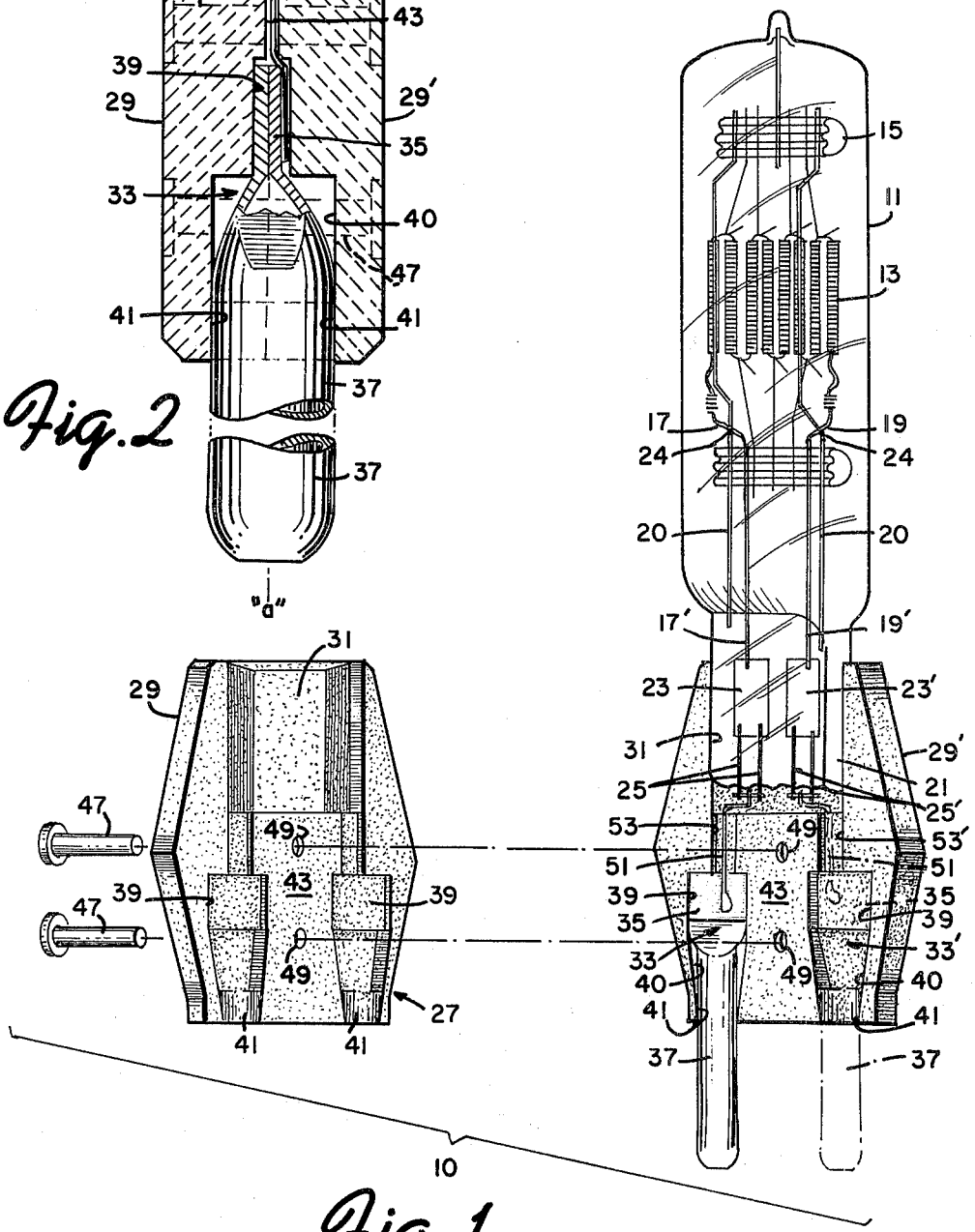
FIG. 1 is an exploded isometric view of a preferred embodiment of the invention.

As illustrated, press-sealed end portion 21 is positioned within a two-part insulative base 27 which includes first part 29 and second part 29'. When assembled (FIG. 2), parts 29 and 29' define therein a cavity 31 for having press-sealed end 21 located therein. The assembled base further defines first and second spacedly-oriented recesses 33 and 33' which serve to house and retain flattened end portions 35 of first and second spaced-apart elongated pins 37. As illustrated in the drawings, pins 37 are each tapered in the region between flattened ends 35 and the tubular (cylindrical) ends which project from the base of the invention. For purposes of clarity, one pin 37 is shown in phantom in FIG. 1. Recesses 33 and 33' each include a slotted region 39 for having flattened ends 35 located therein. By comparison, slotted regions 39 are of much smaller cross-sectional area than the adjoining angular-shaped or tapered portions 40 of recesses 33 and 33' which mate with the tapered portions of pins 37. Adjoining portions 40 also include a restrictive region 41 which assists in the retention of a respective flattened end 35 once parts 29 and 29' are assembled. Each of the restrictive regions 41 includes a substantially semicircular edge 42 which, when parts 29 and 29' are assembled, align to surround and engage the projecting cylindrical portions of pins 37. Understandably, the above positive retention eliminates the need for a sealant (e.g. potting cement) within recesses 33 and 33'. The above described retention is best illustrated in FIG. 3 wherein a partial view of one recess 33 is shown. The portion of pin 37 which is retained therein is shown in phantom.

Parts 29 and 29' are identical to simplify assembly of base 27 and reduce manufacturing and replacement costs. Base 27 further defines a barrier portion 43 which substantially separates cavity 31 from both spaced recesses 33 and 33'. Barrier 43 substantially prevents leakage of sealing material 45 from cavity 31 to the respective recesses. Sealing material 45 (e.g. potting cement) is located about end 21 and is used to positively seat end 21 within cavity 31. Leakage of material 45 to recesses 33 and 33' can result in subsequent leakage of the material from base 27 where it could adversely affect the seating of lamp 10 within a corresponding socket (not shown). Additionally, this material could deleteriously affect the contact between pins 37 and the respective pairs of leads 25 and 25'.

Parts 29 and 29' are preferably secured together by a pair of rivet members 47 which are spacedly aligned within a pair of respective apertures 49 in parts 29 and 29'. This arrangement facilitates disassembly of base 27 in the event that repair or replacement of the various components of lamp 10 is required. Parts 29 and 29' may also be secured by other similar means (e.g. a pair of screws and respective retention nuts).

To further reduce the total weight of lamp 10, the portions of pins 37 other than flat ends 35 are preferably hollow. These portions project from base 27 and are coplanar with the longitudinal ("*a—a*") of lamp 10.

Interconnecting flattened ends 35 of pins 37 and leads 25 and 25' is a pair of substantially rigid connecting wires 51. Wires 51 are located within first and second grooves 53 and 53' which interconnect cavity 31 with recesses 33 and 33', respectively. With regard to the present invention, by rigid is meant of sufficient strength whereby pins 37 will extend unsupported and occupy a horizontal plane when base 27 is removed and envelope 11 is retained horizontally. This feature enhances assembly of the lamp by facilitating alignment of the assembled envelope-pin unit within one part of base 27 and the subsequent location of the second part thereon. Rivets 47 are then employed to secure parts 29 and 29' together after which sealing material 45 is applied.

Parts 29 and 29' are preferably ceramic and hollow pins 37 are preferably of nickel-plated brass. Interconnecting wires 51 are a copper-nickel alloy (Alloy 90) and rivets 47 are aluminum. The material for the remaining components of lamp 10 have been defined or are otherwise known in the art. Pins 37 have a diameter of 0.437 inch while wires 51 have a 0.032 inch diameter.

Thus there has been shown and described a high wattage incandescent lamp which is of much lighter construction than lamps of the prior art. Weight reductions of as much as 20 percent have been realized over such lamps. Additionally, the base structure as described enhances assembly and disassembly of the lamp. The structure also substantially eliminates the possibility of potting cement or similar material from adversely affecting the seating of the lamp within a respective socket and its electrical connection thereto.

While there have been shown and described what are at present considered the preferred embodiments of the invention, it will be obvious to those skilled in the art that various changes and modifications may be made therein without departing from the scope of the invention as defined by the appended claims.

What is claimed is:

1. A high wattage incandescent lamp comprising:

a light-transmitting envelope of vitreous material having a press-sealed end portion;

a halogen-containing atmosphere within said envelope;

a filament structure fixedly mounted within said envelope;

first and second lead-in wires electrically connected to said filament structure, each of said lead-in wires having a portion thereof sealed within said press-sealed end portion of said envelope;

first and second spaced-apart elongated pins electrically connected to said first and second lead-in wires, respectively;

a two-part base of insulative material, said base defining therein a cavity for having said end portion of said envelope positioned therein, first and second spacedly-oriented recesses for securedly retaining therein end portions of said first and second elongated pins, respectively, and a barrier portion for substantially separating said cavity from said spacedly-oriented recesses;

means for securing the two parts of said base together; and a quantity of sealing material positioned within said cavity of said base about said press-sealed end portion of said envelope.

2. The incandescent lamp according to claim 1 wherein said insulative material of said base is ceramic.

3. The incandescent lamp according to claim 1 wherein said means for securing said two parts of said base together comprises at least one rivet member.

4. The incandescent lamp according to claim 3 wherein the number of rivet members is two, said members spaced apart within said base.

5. The incandescent lamp according to claim 1 wherein said end portions of said elongated pins retained within said recesses are substantially flat.

6. The incandescent lamp according to claim 5 wherein the remaining portions of said elongated pins are substantially hollow.

7. The incandescent lamp according to claim 5 wherein each of said first and second recesses within said base include a slotted region, each of said substantially flat end portions of said elongated pins located within a respective one of said slotted regions.

8. The incandescent lamp according to claim 6 wherein said remaining portions of said elongated pins project from said base and are coplanar with the longitudinal axis of said light-transmitting envelope.

9. The incandescent lamp according to claim 7 wherein said base further defines first and second grooves therein, said first groove interconnecting said cavity and said first recess, said second groove interconnecting said cavity and said second recess.

10. The incandescent lamp according to claim 8 wherein each of said recesses includes a restrictive region for substantially surrounding and engaging said projecting portions of said elongated pins.

11. The incandescent lamp according to claim 9 wherein said first and second elongated pins are electrically connected to said first and second lead-in wires, respectively, by a substantially rigid connecting wire, said connecting wires occupying said first and second grooves, respectively.

* * * * *